US006354890B2

(12) United States Patent
Adkins et al.

(10) Patent No.: US 6,354,890 B2
(45) **Date of Patent: *Mar. 12, 2002**

(54) HIGH CURRENT SLEEVE AND POST TERMINALS

(75) Inventors: Robert J. Adkins; Robert Stang; Robert L. Sten, all of Warren, OH (US)

(73) Assignee: Delphi Technologies, Inc., Troy, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/527,837

(22) Filed: Mar. 17, 2000

(51) Int. Cl.[7] ..... H01R 13/187
(52) U.S. Cl. ..... 439/843; 439/851; 439/859
(58) Field of Search ..... 439/843, 851, 439/852, 856, 857, 858, 859

(56) References Cited

U.S. PATENT DOCUMENTS 5,720,634 A 2/1998 Sten ..... 439/843
6,086,434 A * 7/2000 Rollero et al. ..... 439/852

* cited by examiner

*Primary Examiner*—Tho D. Ta
*Assistant Examiner*—Truc Nguyen
(74) *Attorney, Agent, or Firm*—Thomas A. Twomey

(57) ABSTRACT

A sleeve and post terminals combination, wherein a single piece sleeve terminal which is slidingly interfaced with a smooth surfaced post terminal for high current circuit applications. The sleeve terminal is formed from sheet metal stock, having an inner sleeve component and an outer sleeve component. The inner sleeve component includes three circumferentially spaced electrical contracts. The post terminal is configured to be snugly received by the inner sleeve component, wherein the three contacts are radially forced against the post terminal. The post terminal preferably has a bullet nose and has a smooth surface. In a preferred environment of operation, the post terminal is connected with a BEDC, and the sleeve terminal is connected with a high current capacity wire.

13 Claims, 3 Drawing Sheets

HIGH CURRENT SLEEVE AND POST TERMINALS

TECHNICAL FIELD

The present invention relates to sleeve terminals and pin and post terminals, and more particularly to a single piece construction sleeve terminal and bullet nosed post terminal combination suited for high current automotive applications.

BACKGROUND OF THE INVENTION

Threaded studs with threaded nuts are used in conjunction with ring terminals to secure high current connections in automotive applications. Typically, the ring terminal has a hole which receives the threaded stud and then the nut is threaded onto the threads of the stud and tightened. While this arrangement is very robust and has long term reliability, it suffers from being ergonomically inefficient for an installer to perform all the attendant steps related thereto.

Increasingly, automotive electrical systems utilize bussed electrical distribution centers. A bussed electrical distribution center (hereinafter referred to simply as a "BEDC") is a stand-alone central junction block assembly. BEDC's package, for example, various fuses, relays and electronic devices in a single central location. BEDC's not only save cost by consolidating electrical interconnections, advantageously the number of cut and spliced leads is reduced, thereby increasing reliability.

It would be very desirable if a BEDC could be connected to a high current circuit with a terminal construction far simpler than the standard threaded stud, nut and ring terminal combination.

SUMMARY OF THE INVENTION

The present invention is a sleeve terminal and post terminal combination, wherein a single piece sleeve terminal which is slidingly interfaced with a smooth surfaced post terminal for high current circuit applications.

The sleeve terminal according to the present invention is formed from a single piece of sheet metal stock, having an inner sleeve component and an outer sleeve component. The inner sleeve component includes three circumferentially spaced electrical contacts, wherein one of the contacts is integrally connected with the outer sleeve component, and is oppositely integrally connected to a wire mount.

The post terminal is configured to be snugly received by the inner sleeve component, wherein the three contacts are radially pressed against the post terminal. The post terminal preferably has a bullet nose and a smooth surface.

In a preferred environment of operation, the post terminal is connected with a BEDC, and the sleeve terminal is connected with a high current capacity wire. In operation, the sleeve terminal is positioned over the nose of the post terminal and the post terminal is then thrust into the sleeve terminal, wherein it is received into the inner sleeve component. The radial force of the three contacts against the post terminal ensures an excellent electrical connection between the post terminal, the sleeve terminal, and, ultimately, the wire connected with the sleeve terminal.

Accordingly, it is an object of the present invention to provide a sleeve terminal and post terminal combination which is applicable to high current applications.

This, and additional objects, advantages, features and benefits of the present invention will become apparent from the following specification.

DETAILED DESCRIPTION OF THE PREFERRED EMBODIMENT

Figure 1:
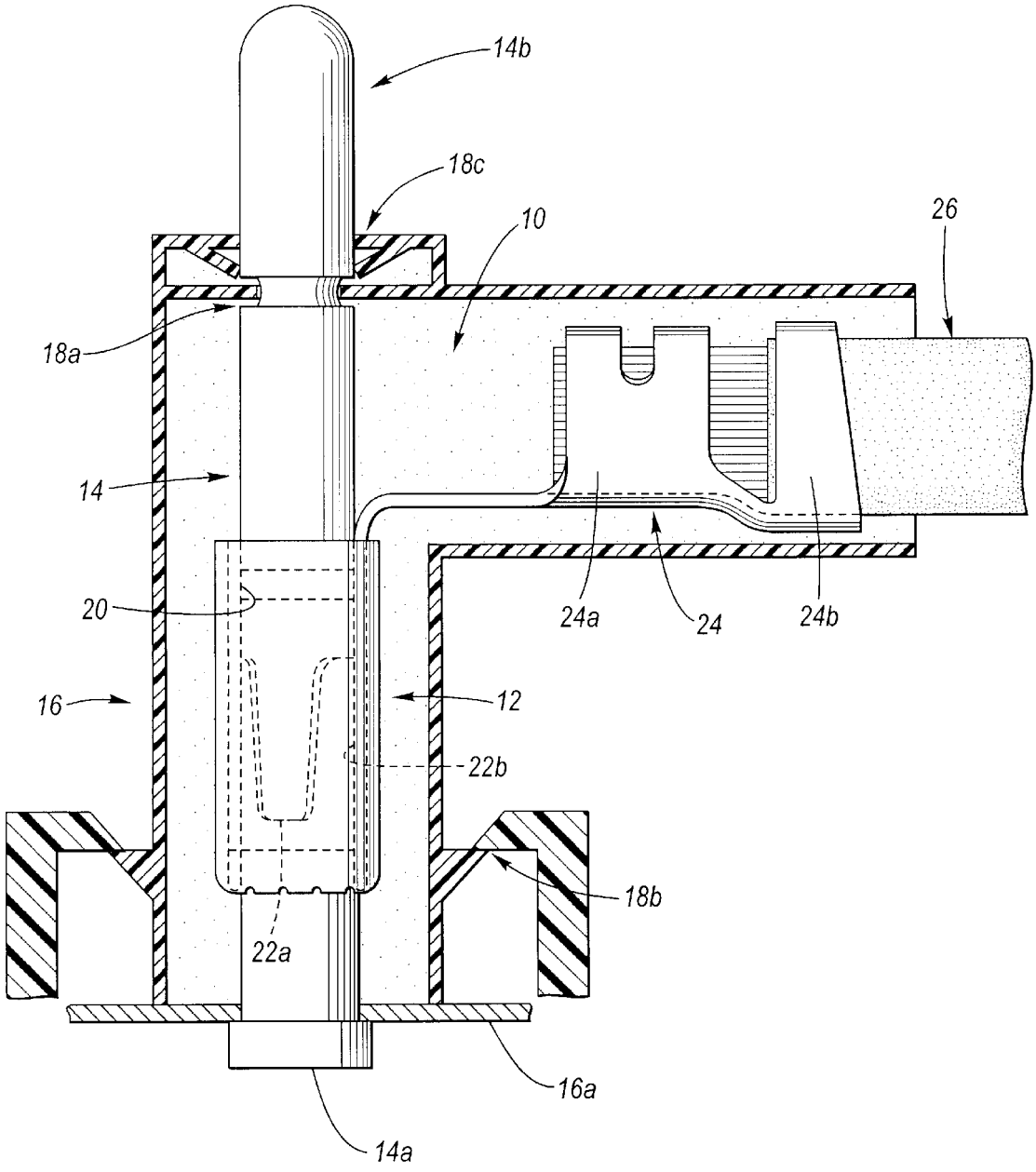
FIG. 1 is a side view of the sleeve and post terminal combination according to the present invention, shown in an automotive environment of operation.
Figure 2:
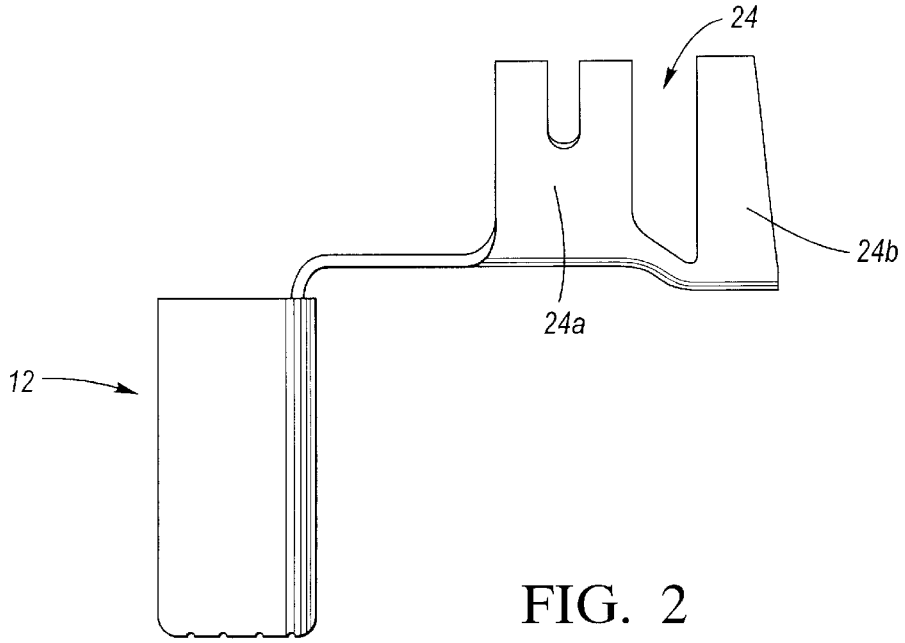
FIG. 2 is a side view of the sleeve terminal according to the present invention.
Figure 3:
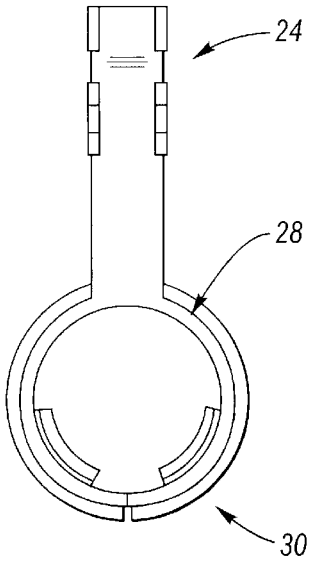
FIG. 3 is a top plan view of the sleeve terminal according to the present invention.
Figure 4:
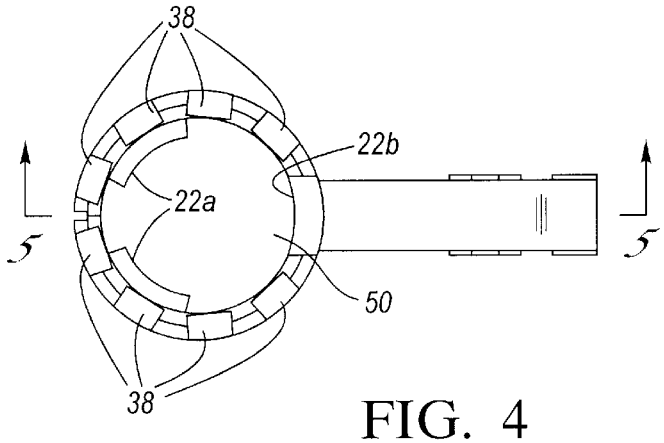
FIG. 4 is a bottom plan view of the sleeve terminal according to the present invention.

Referring now to the Drawing, FIG. 1 depicts a sleeve and post terminal combination 10, wherein the sleeve terminal 12 is depicted operatively receiving the post terminal 14.

The post terminal 14 is cylindrically shaped, being crimped at its lower end 14*a* and bullet shaped at its upper end 14*b*. The post terminal 14 is composed of a conductive metal material, which may be plated to prevent oxidation and promote good electrical contact surface. The post terminal 14 is connected by way of example to a BEDC 16, wherein the upper end 14*b* preferably projects outwardly from the BEDC, and serves as an external connection location, as for example for connecting thereto an alligator clamp of a battery jumper cable. The lower end 14*a* of the post terminal 14 is shown connected with the BEDC 16 at a buss plate 16*a*, and at least one connector position assurance feature 18*a*, 18*b*, 18*c* is provided to additionally affix the post terminal to the BEDC.

The sleeve terminal 12 is located in a plastic holder 16*b* of the BEDC. The sleeve terminal 12 includes an internal cylindrical cavity 20 having a plurality of electrical contacts in the form of two tab contacts 22*a* and a spine contact 22*b* which snugly receive the post terminal 14, thereby providing an excellent electrical connection therebetween. The sleeve terminal 12 further includes a wire connection feature 24 which includes a wire crimp component 24*a* and a jacket crimp component 24*b* for connecting a high current carrying wire 26 to the sleeve terminal.

Referring now to FIGS. 2 through 8, the structural aspects of the sleeve terminal 14 will be further elaborated.

The sleeve terminal 12 is composed of an inner sleeve component 28 and an outer sleeve component 30 from a single piece of sheet metal stock, preferably a plated stock. The outer sleeve component 30 serves as a robust external casing for the inner sleeve component 28. The inner sleeve component 28 tightly abuts the outer sleeve component and features an upper ring 32 and a lower ring 34. Integral with the lower ring 34 are the pair of tab contacts 22*a*. The upper and lower rings 32, 34 are integrally connected with a spine 35 which extends the length of the inner sleeve component 28, integrally connecting at one end to the outer sleeve component 30 at a bend 36 and integrally connecting at the opposite end to the wire connection feature 24.

Figure 6:
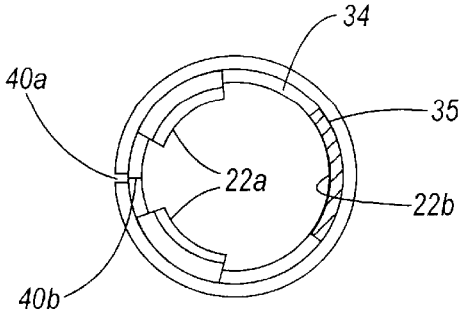
FIG. 6 is a sectional view taken along line 6—6 in FIG. 5.
Figure 5:
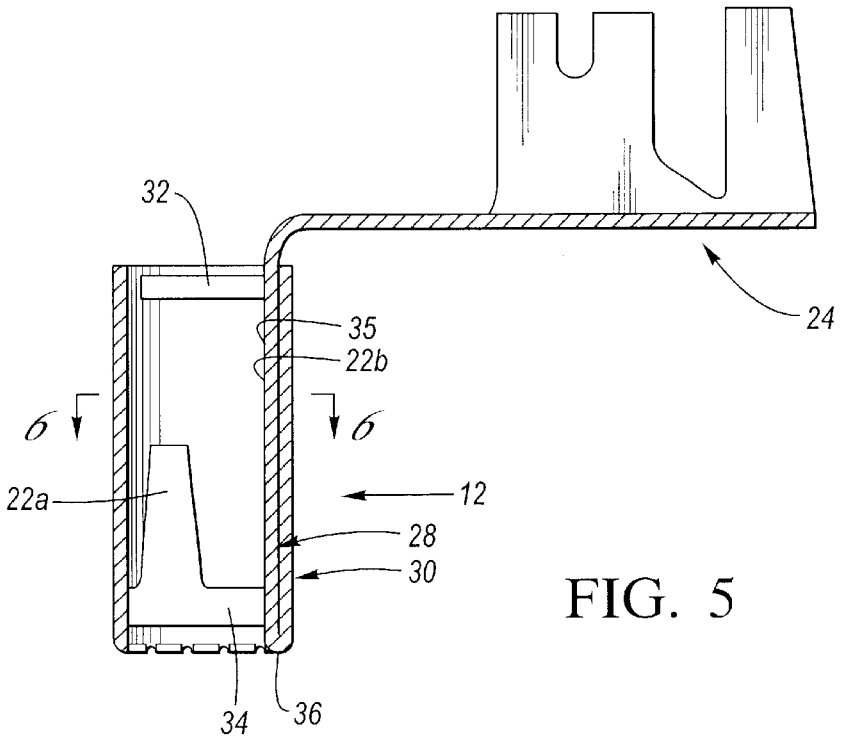
FIG. 5 is a sectional view taken along line 5—5 in FIG. 4.
Figure 7:
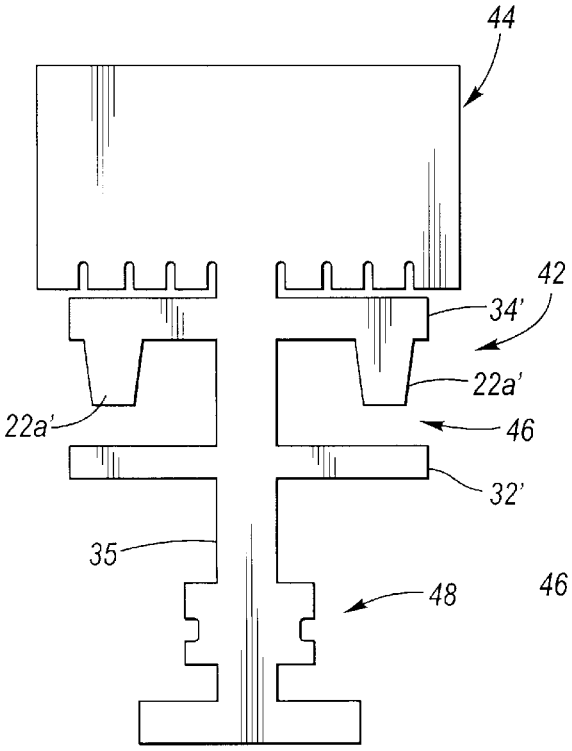
FIG. 7 is a top plan view of a sleeve pattern die cut from a sheet of flat metal stock.
Figure 8:
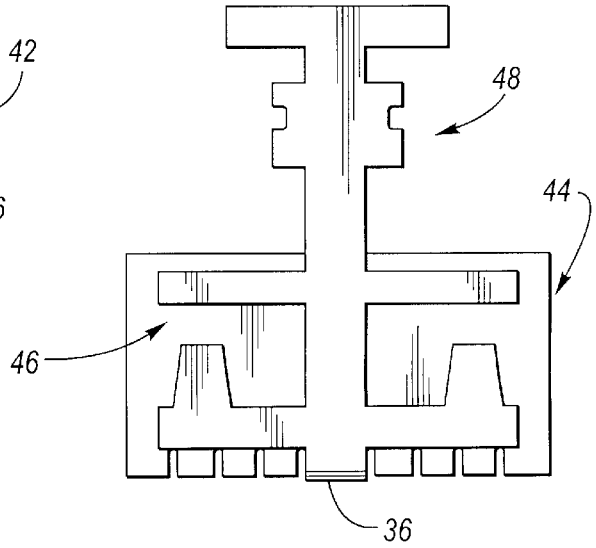
FIG. 8 is a top plan view of the sleeve pattern of FIG. 7, now shown after a bending step.

As shown at FIG. 6, the two tab contacts 22*a* are equidistantly spaced in relation to the spine 35, wherein the spine forms the spine contact 22*b* so as to serve in concert with the two tab contacts to electrically interface with the post terminal 14. In this regard, the two tab contacts 22*a* are each radially oriented inward, wherein the tips thereof are resiliently spaced from the outer sleeve component 30 so as to apply a radial pressure, in combination with the spine contact, against the post terminal 14. In order to provide robustness and define the lower opening 50 of the sleeve terminal 12, the outer sleeve component 30 has a plurality of fingers 38 which are bent into a radial orientation. A vertical seam 40*a*, 40*b* is formed respectively of the outer and inner sleeve components 30, 28 as a result of a forming process, as follows.

Beginning with a rectangular piece of sheet metal stock, a die cutting results in a sleeve pattern 42. The sleeve pattern 42 includes a base portion 44 from which is formed the outer sleeve component, a medial portion 46 from which is formed the inner sleeve component and a stem portion 48 from which is formed the wire connection feature. It can be discerned that the medial portion 46 includes a spine member 35', a pair of tab contact members 22*a*', an upper ring member 32' and a lower ring member 34'. The base, medial and stem portions 44, 46, 48 are then bent to form the sleeve terminal 12, including the bend 36 depicted at FIG. 8. By way of example, the sheet metal stock may have a thickness of about 0.1 cm., the length of the outer sleeve may be about 3.2 cm., the inside diameter of the inner sleeve component may be about 0.6 cm. and the outside diameter of the outer sleeve component may be about 1 cm.

Referring again to FIG. 1, operation of the sleeve and post terminal combination 10 will be described.

The wire 26 is crimpingly attached to the wire attachment feature 24 so that a good electrical connection is provided therebetween. Next sleeve terminal 12 is placed aligningly over the upper end 14*b* and then the post terminal 14 is thrust into the center cavity 20 of the sleeve terminal, whereupon the tab contacts 22*a* and the spine contact 22*b* collectively radially press against the post terminal, thereby providing an excellent electrical connection therebetween. The sleeve terminal is then slid into a preselected location on the post terminal, as for example shown at FIG. 1.

To those skilled in the art to which this invention appertains, the above described preferred embodiment may be subject to change or modification. Such change or modification, such as for example a modification of the shape of the resilient lock arms, can be carried out without departing from the scope of the invention, which is intended to be limited only by the scope of the appended claims.

What is claimed is:

1. A sleeve terminal comprising:

an outer sleeve component having a lower end;

an inner sleeve component having a spine, said spine having a first end and a second end, said first end of said lower end of said spine being integrally connected to said lower end of said outer sleeve, said inner sleeve being concentrically located within said outer sleeve, said inner sleeve having a lower ring connected to said first end of said spine, a plurality of electrical contacts being connected with said lower ring and said spine; and a wire mount feature connected to said second end of said spine.

2. The sleeve terminal of claim 1, further comprising an upper ring connected to said spine.

3. The sleeve terminal of claim 1, further comprising a plurality of fingers connected with said outer sleeve component at said lower end thereof, each finger being radially oriented to thereby define a lower opening of said sleeve terminal.

4. The sleeve terminal of claim 1, wherein said plurality of electrical contacts comprise a pair of tab contacts connected with said lower ring and a spine contact connected with said spine.

5. The sleeve terminal of claim 2, further comprising a plurality of fingers connected with said outer sleeve component at said lower end thereof, each finger being radially oriented to thereby define a lower opening of said sleeve terminal.

6. The sleeve terminal of claim 5, wherein said plurality of electrical contacts comprise a pair of tab contacts connected with said lower ring and a spine contact connected with said spine.

7. A sleeve and post terminal combination comprising:

a post terminal;

a sleeve terminal comprising: an outer sleeve component having a lower end, and an inner sleeve component having a spine, said spine having a first end and a second end, said first end of said spine integrally connected to said lower end of said outer sleeve, said inner sleeve being concentrically located within said outer sleeve, said inner sleeve having a lower ring connected to said first end of said spine, a plurality of electrical contacts being connected to said lower ring and said spine; and a wire mount feature connected to said second end of said spine;

wherein when said post terminal is received into said sleeve terminal, said plurality of electrical contacts radially press against said post terminal.

8. The sleeve terminal of claim 7, further comprising an upper ring connected to said spine.

9. The sleeve terminal of claim 7, further comprising a plurality of fingers connected with said outer sleeve component at said lower end thereof, each finger being radially oriented to thereby define a lower opening of said sleeve terminal.

10. The sleeve terminal of claim 7, wherein said plurality of electrical contacts comprise a pair of tab contacts connected with said lower ring and a spine contact connected with said spine.

11. The sleeve terminal of claim 8, further comprising a plurality of fingers connected with said outer sleeve component at said lower end thereof, each finger being radially oriented to thereby define a lower opening of said sleeve terminal.

12. The sleeve terminal of claim 11, wherein said plurality of electrical contacts comprise a pair of tab contacts connected with said lower ring and a spine contact connected with said spine.

13. A sleeve terminal comprising:

an outer sleeve component having a lower end;

an inner sleeve component having a spine integrally connected to said outer sleeve, said inner sleeve being concentrically located within said outer sleeve, said inner sleeve having a lower ring connected to said spine, a plurality of electrical contacts being connected with said lower ring and said spine; and a plurality of fingers connected with said outer sleeve component at said lower end thereof, each finger being radially oriented to thereby define a lower opening of said sleeve terminal.

* * * * *